US005651455A

United States Patent [19]

Garcia

[11] Patent Number: 5,651,455

[45] Date of Patent: Jul. 29, 1997

[54] UTILITY ACCESSORY BAG

[76] Inventor: Marjorie Garcia, 25292 Calle Becerra, Laguna Niguel, Calif. 92677

[21] Appl. No.: 682,307

[22] Filed: Jul. 17, 1996

[51] Int. Cl.[6] ..... B65D 85/18

[52] U.S. Cl. ..... 206/287.1; 383/14; 383/16; 383/117

[58] Field of Search ..... 383/23, 14, 16, 383/4, 102, 117, 39; 206/287, 287.1

[56] References Cited

U.S. PATENT DOCUMENTS

| | | | |
|---|---|---|---|
| D. 348,754 | 7/1994 | Feller | D3/39 |
| 3,123,279 | 3/1964 | Day | 383/102 |
| 3,642,967 | 2/1972 | Doll | 383/117 X |
| 4,685,570 | 8/1987 | Medow | 383/39 X |
| 5,002,183 | 3/1991 | Okano | 206/287 |
| 5,025,918 | 6/1991 | Bergeron | 383/39 X |
| 5,238,305 | 8/1993 | Feller | 383/117 X |
| 5,401,101 | 3/1995 | Wang | 383/117 X |

*Primary Examiner*—Jes F. Pascua
*Attorney, Agent, or Firm*—Edward E. Roberts

[57] ABSTRACT

An accessory bag of generally rectangular configuration and having flexible front and back members. The back member is formed of a generally imperforate flexible material with the front member having a like configuration and formed of an open mesh flexible material with a substantial portion of the periphery thereof secured together. A zipper or the like is attached to the balance of the periphery. The upper and lower edges of opposite sides of the mesh surface are provided with mating fasteners, such as Velcro strips or snaps at positions suitable for enabling coupling of the fasteners to one another with the bag folded with the back member exposed. The mesh material has the openings thereof sufficiently large for enabling insertion of a finger therethrough, whereby the bag may be utilized for small articles such as small clothing items, hair pieces, scarves or the like, which may be viewed through and extracted through the openings of the mesh material by use of a finger without opening the bag. The articles may be partially removed for display as desired. For purpose of hanging the bag, one edge is provided with a pivotable or retractable hook or hanger member, while the opposite edge is provided with a strap or handle to permit carrying the bag.

11 Claims, 2 Drawing Sheets

UTILITY ACCESSORY BAG

BACKGROUND OF THE INVENTION

1. Field of the Invention

This invention relates to bags, and more particularly to an at least partially open-meshed flexible accessory or utility bag for small articles and fine items of clothing having provision for viewing and removal of such small articles and items through the open-meshed portion.

2. Description of the Prior Art

Bags formed of flexible material are not uncommon. Such bags are formed of cloth or plastic material, in a variety of ways and may be transparent or opaque, and in a variety of sizes. Such bags have a variety of uses, although many are limited due to the size or construction of the bag. For items of apparel or clothing, garment bags having a zippered side edge have been manufactured of plastic material for storage of the clothing in a generally airtight or mothproof environment, usually with a hook or hanger on one edge thereof for hanging within a closet. Such plastic garment bags may be formed of transparent material for enabling viewing of the contents. Flexible zippered pocket bags may be formed of small size for containing portable small items such as accessories or pocket change or the like.

U.S. Pat. No. 5,238,305 issued to Feller on 24 Aug. 1993 discloses one such accessory bag of net material for hanging in a shower and containing shampoo and the like.

In accordance with a feature of the present invention, there is provided a new and improved utility or accessory bag for storage and retention of small items of clothing or other small accessories such as barrettes or hairpieces, with provision for enabling viewing of items through the transparent material as well as through open-mesh portions therein, and for removal, or partial removal, of a particular item through "finger holes" in the open-mesh portions without opening of the bag.

SUMMARY OF THE INVENTION

The foregoing and other objects of the invention are accomplished by providing an accessory bag of generally rectangular configuration and having flexible front and back members. The back member is formed of a generally rectangular configuration and having flexible front and back members. The back member is formed of a generally imperforate flexible material, with the front member having a similar configuration but formed of a partially open mesh flexible material with a substantial portion of the periphery thereof secured together. A zipper or the like is attached to the balance of the periphery. The upper and lower edges of opposite sides of the mesh surface are provided with mating fasteners, such as Velcro strips or snaps at positions suitable for enabling coupling of the fasteners to one another with the bag folded with the back member exposed.

The mesh material has the openings thereof sufficiently large for enabling insertion of a finger therethrough, whereby the bag may be utilized for small articles such as small clothing items, hair pieces, scarves or the like, which may be viewed through and extracted through the openings of the mesh material by use of a finger without opening the bag. The mesh material may be flexible for enabling stretching of the mesh openings, or finger holes, to facilitate partial removal for exhibition or for complete removal of articles contained in the bag.

For purpose of hanging the bag, one edge is provided with a pivotable or retractable hook or hanger member, while the opposite edge is provided with a strap or handle to permit carrying the bag.

Other objects, features and advantages of the invention will become apparent on a reading of the specification when taken in conjunction with the drawings in which like reference numerals refer to like elements in the several views.

DESCRIPTION OF THE PREFERRED EMBODIMENT

Figure 1:
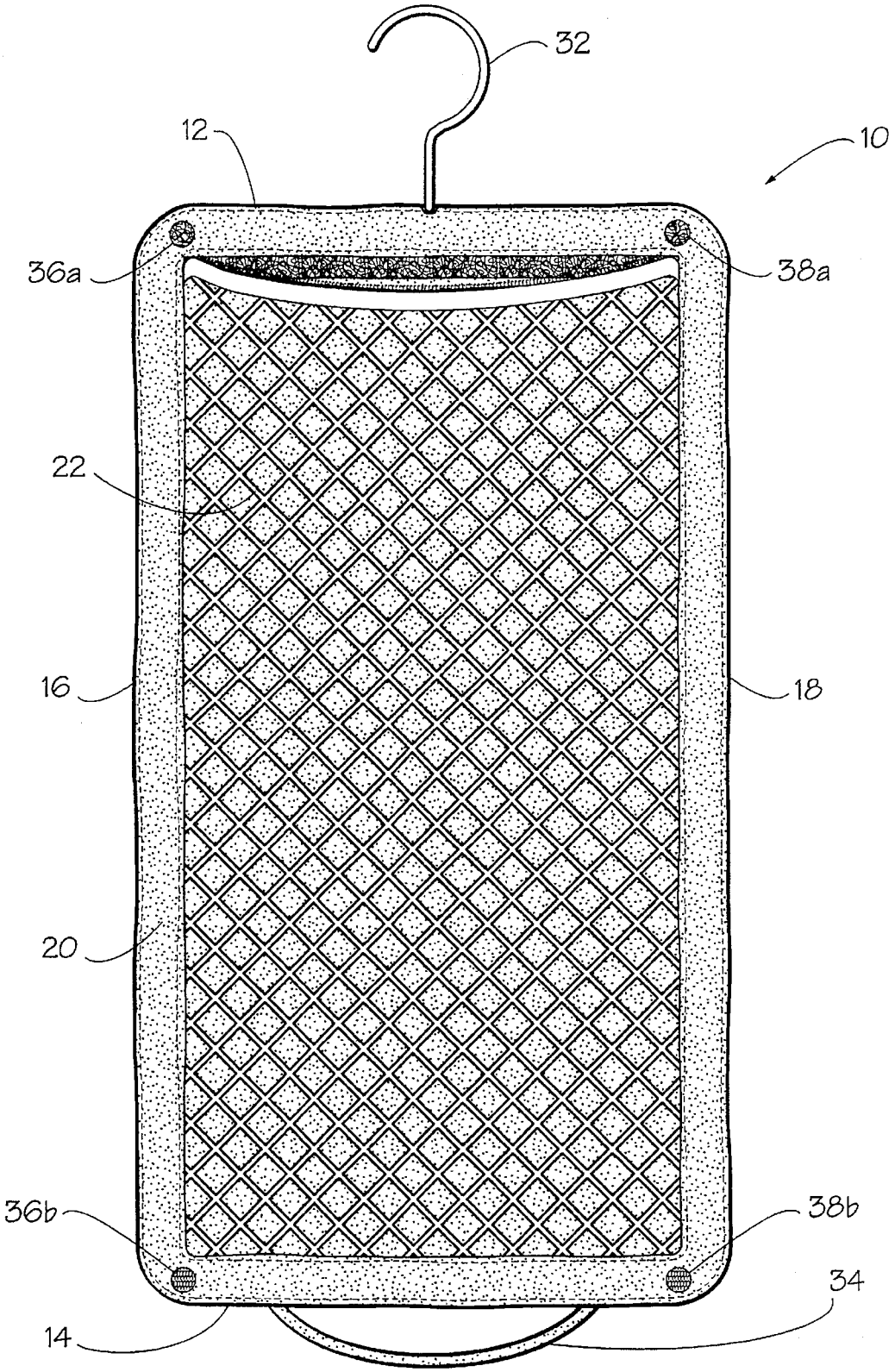
FIG. 1 is a front plan view of the accessory bag according to the invention, the bag being in its open position suitable for hanging within a closet or from a rod.

Referring now to the drawings and particularly to FIG. 1, there is shown an accessory bag, generally designated 10, the bag 10 being of generally rectangular configuration and having a top edge 12, a bottom edge 14, and opposite side edges 16 and 18. The bag 10 includes a back member 20 and a front member 22, which are secured together at the side and bottom edges, 16, 14 and 18, respectively, such as by sewing. The upper edge 12 is provided with a closure means, such as a zipper 24. Alternatively, any other suitable closure means may be employed, such as Velcro (hook and loop) closure strip, or snaps or the like.

The back member 20 is formed of a generally imperforate flexible cloth-like material which may be cloth, leather, suede plastic or any adequate artificial fabric. The front member 22, however, is formed of a net-like or mesh material which is shown in FIG. 1 as having diamond shaped openings 30, or "finger holes", being of a relatively large size sufficient for insertion of the finger of a person therethrough. The bag 10 is intended for usage for storage, retention, display, and carrying of generally small items of apparel or accessories, such as scarves, lingerie items, barrettes, hair pieces, elastic hair holding members, or the like.

The mesh material of member 22 makes such items readily viewable and quickly accessible without opening of the zipper. The material may also be transparent for permitting more complete viewing of the items. Due to the size of the openings 30, articles within the bag 10 may be manipulated and moved to permit retraction of the desired article, yet doesn't allow the items to fall through the openings. Thus, the items are held in place, readily observable through transparent holding material, and readily pulled through, or partially pulled through, openings in the transparent material with no need for opening of the bag.

The material may be inflexible with openings large enough for pulling items therethrough, or may be flexible with smaller stretchable openings, or "finger holes". The bag of the invention has uses such as for holding and providing easy selection and access to hair decorative items made of plastic and fabric that are used for holding pony tails, hair buns, braids and the like. Likewise, items, such as scarves, may be partially pulled through the openings for sales display or merely for decorative purposes. The material may be net-like with relatively large openings compared to the material surface, or item holding, portion of the material, or the material surface may be less, or partially, open with relatively larger strip-like portions with the openings therein. The openings are shown as generally diamond shaped, however, other suitable configurations and designs of the mesh material and "finger holes" are contemplated as being within the scope of the invention.

Figure 2:
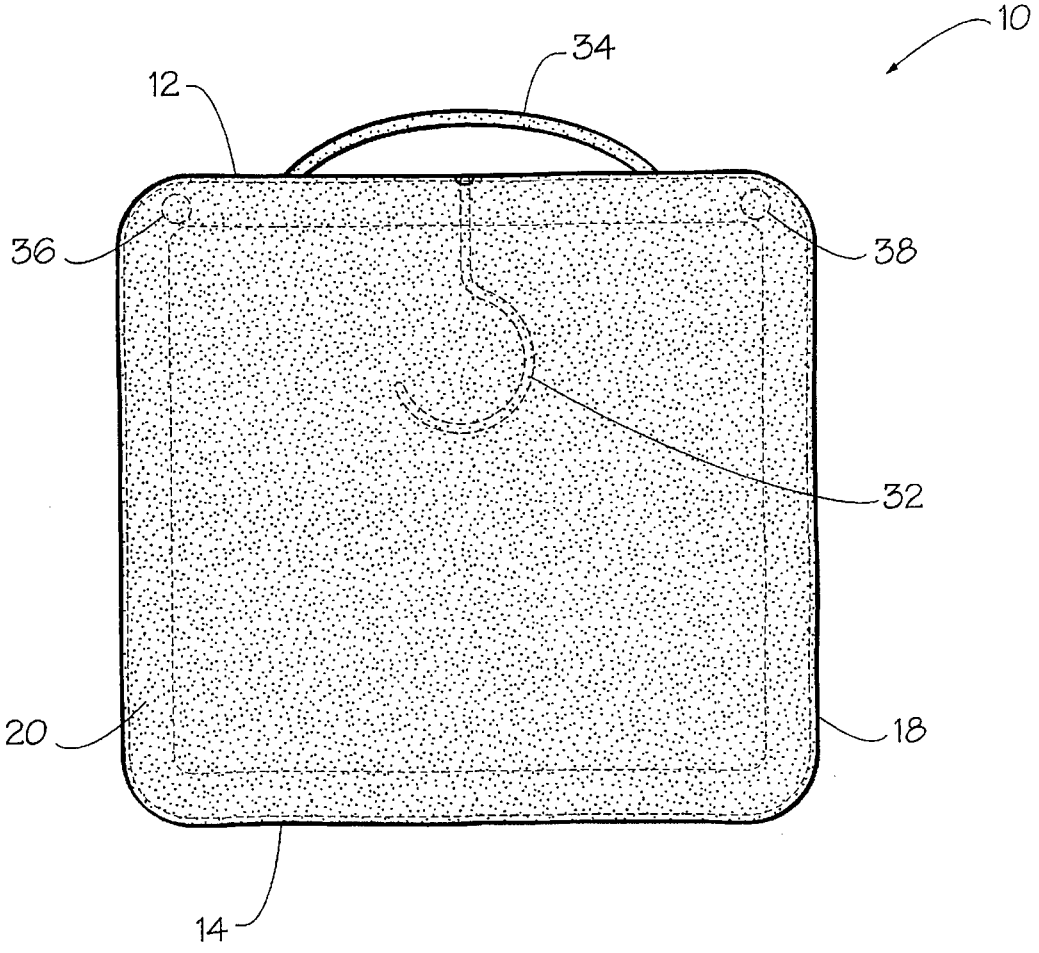
FIG. 2 is a plan view of the bag of FIG. 1 in its folded ready-for-carry position.

For enabling hanging of the bag 10, the top edge 12 is provided with a hook or hanger 32, which is centrally positioned, and pivotable or retractable into a withdrawn position as shown in dotted lines in FIG. 2. The bottom edge 14 has secured thereto a flexible handle 34, which may be formed of cloth or other suitable material which has opposite ends thereof attached to the bottom edge 14, such as by sewing or other suitable means.

The bag 10 may be folded from its position shown in FIG. 1 to the position shown in FIG. 2, that is, with the mesh front member 22 folded into itself, so that only the imperforate back member 20 is exposed. For this purpose, the mesh side of the bag 10 is provided with suitable mating fastener means, such as snaps 36 and 38, arranged in pairs, i.e., mating coacting snap portions 36*a*, 36*b* and snap portions 38*a*, 38*b*.

The snaps 36 and 38 are positioned and attached in aligned relation adjacent the four corners of bag 10 which include the opposite sides of each of the top and bottom edges 12 and 14. On folding, the snaps 36*a* and 38*a* are joined with mating snap portions 36*b* and 38*b*, respectively, with the bag then being in the portable or carrying position shown in FIG. 2 with the back member 12 exposed. Other suitable fasteners may be utilized, such as Velcro closures.

For aesthetic reasons, the exposed surface of member 20 may have a pleasing color, or a colorful pattern or design, such as a floral pattern or the like. While no particular size is specified, nor required, in the preferred embodiment, an average size of about ten inches by twenty inches would be sufficient for the articles hereinabove specified. For non-portable usage, the bag 10 may be much larger and the carrying handle 34 may be eliminated.

In the above description, it is to be understood that the usage of bi-directional terms, such as top and bottom are with reference to the articles as shown in the figures and is not intended to be limiting.

In accordance with the present invention there has been shown and described a flexible foldable portable accessory bag of economical compact construction. The items are held in place, readily observable through transparent holding material, and readily pulled through, or partially pulled through, openings in the transparent material with no need for opening of the bag.

Although there has been shown and described a preferred embodiment, it is to be understood that other modifications may be made within the spirit and scope of the invention.

What is claimed is:

1. An accessory bag comprising:

a back member formed of a generally rectangular generally imperforate flexible material;

a front member of a like configuration formed of an open mesh flexible material overlying said back member in aligned relation thereto and having a substantial portion of the periphery thereof secured together, said mesh material having openings of a size sufficient for insertion of a finger therethrough;

closure means attached to the remaining portions of the aligned peripheries of said back member and said front member; and mating fastener means secured to opposite edges of the periphery of the thus joined members at positions suitable for enabling coupling of said fastening means to one another with the thus joined members folded with said edges overlying one another with said back member exposed, whereby said bag may be utilized for small articles such as small clothing items, hair pieces, scarves or the like, which may be viewed through and retracted through said openings of said mesh material.

2. The bag of claim 1 wherein said mesh material includes, relative to said openings, larger strip like surfaces of transparent material.

3. The bag of claim 2 wherein said openings are generally diamond shaped.

4. The bag of claim 1 further including retractable hanger means attached to one of said opposite edges.

5. The bag of claim 1 further including handle means attached to one of said hanger opposite edges.

6. The bag of claim 5 further including retractable hanger means attached to the other of said opposite edges.

7. An accessory bag comprising:

a back member formed of a generally rectangular generally imperforate flexible material and having top and bottom edges and opposing sides;

a front member of a like configuration formed of an open mesh flexible material overlying said back member in aligned relation thereto and having a substantial portion of the periphery thereof secured together at said sides and said bottom edges, said mesh material having openings of a size sufficient for insertion of a finger therethrough;

closure means attached to said top edge of the aligned peripheries of said back member and said front member; and mating fastener means secured to opposite corners of said top and bottom edges for enabling coupling of said fastening means to one another with the thus joined members folded with said edges overlying one another with said back member exposed, whereby said bag may be utilized for small articles such as small clothing items, hair pieces, scarves or the like, which may be viewed through and retraced through said openings of said mesh material.

8. The bag of claim 7 further including retractable hanger means attached to said top edge.

9. The bag of claim 8 further including handle means attached to said bottom edge.

10. The bag of claim 7 wherein said mesh material includes, relative to said openings, larger strip like surfaces of transparent material.

11. The bag of claim 10 wherein said openings are generally diamond shaped.

* * * * *